US009633640B1

(12) United States Patent
Lee

(10) Patent No.: US 9,633,640 B1
(45) Date of Patent: Apr. 25, 2017

(54) GUITAR EFFECTOR

(71) Applicant: Seung Jae Lee, Seoul (KR)

(72) Inventor: Seung Jae Lee, Seoul (KR)

(73) Assignee: Seung Jae Lee, Seoul (KR)

( * ) Notice: Subject to any disclaimer, the term of this patent is extended or adjusted under 35 U.S.C. 154(b) by 0 days.

(21) Appl. No.: 15/363,322

(22) Filed: Nov. 29, 2016

(30) Foreign Application Priority Data

Aug. 16, 2016 (KR) ..... 10-2016-0103689

(51) Int. Cl.
*G10H 1/34* (2006.01)
*G10H 1/46* (2006.01)

(52) U.S. Cl.
CPC ..... *G10H 1/348* (2013.01); *G10H 1/46* (2013.01); *G10H 2210/251* (2013.01); *G10H 2210/281* (2013.01); *G10H 2210/311* (2013.01)

(58) Field of Classification Search
CPC ..... G10H 1/18; G10H 1/043; G10H 1/348; G10H 2220/116; G10H 2240/161; G10H 2240/211; G10H 1/46; G10H 2210/251; G10H 2210/281; G10H 2210/311
USPC ..... 84/615, 711
See application file for complete search history.

(56) References Cited

U.S. PATENT DOCUMENTS 6,215,055 B1 * 4/2001 Saravis ..... G10H 1/348 84/422.1
7,005,571 B1 * 2/2006 Groff ..... G10H 1/348 84/615
7,373,210 B2 * 5/2008 Pennock ..... G10H 1/02 381/118
7,525,038 B2 * 4/2009 Yamada ..... G10H 1/0091 84/622
8,642,870 B1 * 2/2014 Rosa ..... A47G 27/0212 84/453
2006/0011052 A1 * 1/2006 Purchon ..... G10H 1/0091 84/746
2009/0229449 A1 * 9/2009 Yamada ..... G10H 1/348 84/612
2010/0195840 A1 * 8/2010 Ciccone ..... G10H 1/0091 381/61
2010/0229710 A1 * 9/2010 Schoewer ..... G10H 1/0066 84/701
2010/0269670 A1 * 10/2010 O'Connor ..... G10H 1/0091 84/626
2011/0271821 A1 * 11/2011 McKinney ..... G10H 1/348 84/746
2013/0312588 A1 * 11/2013 Orshan ..... G10H 1/0091 84/609

(Continued)

*Primary Examiner* — Jeffrey Donels
(74) *Attorney, Agent, or Firm* — Cantor Colburn LLP

(57) ABSTRACT

Provided is an adjustment unit for guitar effector that is installed between input unit and output unit to adjust a volume and a tone based on the output signal by using a variable resistor in an analog circuit. The adjustment unit comprises one or more of a level part that adjusts a size of the output signal, a tone part that adjusts an amount of high-pitched sound and an amount of low-pitched sound, and a distortion part that adjusts a degree of distortion, one or more of the level part, the tone part and the distortion part are plural, and a switch comprising one or more of a level switch for selecting any one of the plurality of level parts, a tone switch for selecting any one of the plurality of tone parts, and a distortion switch for selecting any one of the plurality of distortion parts is installed.

9 Claims, 23 Drawing Sheets

(56) References Cited

U.S. PATENT DOCUMENTS

| | | | | |
|---|---|---|---|---|
| 2013/0327201 | A1* | 12/2013 | Urry | G10H 1/06 84/626 |
| 2014/0090546 | A1* | 4/2014 | Ceccolini | G10H 1/02 84/626 |
| 2014/0205113 | A1* | 7/2014 | Slipp | G10H 7/008 381/119 |
| 2015/0161978 | A1* | 6/2015 | Packouz | G10H 1/40 84/746 |
| 2015/0262566 | A1* | 9/2015 | Ceccolini | G10H 1/348 84/746 |
| 2016/0019877 | A1* | 1/2016 | Remignanti | G10H 1/0066 84/645 |
| 2016/0063976 | A1* | 3/2016 | Wilk | G10H 1/055 84/626 |
| 2016/0258574 | A1* | 9/2016 | Abbate | G10H 1/32 |
| 2016/0275928 | A1* | 9/2016 | Lee | G10H 1/0091 |
| 2016/0293151 | A1* | 10/2016 | Mayo | G10H 1/34 |

* cited by examiner

GUITAR EFFECTOR

BACKGROUND OF THE INVENTION

1. Field of the Invention

The present disclosure relates to a musical instrument and, more particularly, to an effector for a guitar.

2. Description of the Prior Art

Various kinds of effectors are used to distort a tone of an electronic guitar.

Such effectors may be classified into an analogue type and a digital type. The latter has an advantage in that use thereof is convenient but has a disadvantage in that a sound quality thereof is low. Thus, in recent years, an effector using an analogue scheme tends to be mainly used.

The effector using an analogue scheme, which refers to a compactor, includes: an input unit 3 that receives an input signal from a guitar 1 or another guitar effector; an output unit 4 that transmits an output signal to an amplifier 2 or the second guitar effector; and a foot switch 5 that controls an on-off state of the corresponding compactor (see FIGS. 1 to 10).

Because a player adjusts an on-off state thereof during playing through the foot switch 5, the effector refers to a guitar pedal.

For example, in case of backing for expressing rock music or solo performance, effectors such as an overdrive effector and a distortion effector are required (see FIGS. 1 and 2), in case of arpeggios or strokes, to obtain a clean tone, effectors such as a reverb effector, a delay effector and a chorus effector are required (see FIGS. 3 to 5), when a special effect is required, effectors such as a phase effector, a wah effector and an octave effector are required (see FIGS. 6 to 8), and in other cases, a compressor effector, an equalizer effector, or the like may be used (see FIGS. 9 and 10).

Such guitar effectors include an adjustment unit 500 that adjusts a volume or a tone based on an output signal through a variable resistor in an analogue circuit (that is formed to perform adjustment by a variable resistor driving unit), and the adjustment unit 500 generally includes a level part 510, a tone part 520 and a distortion part 530.

The level part 510 adjusts a size of the output signal, and almost all guitar effectors include the same.

The tone part 520 adjusts an amount of a high-pitched sound and an amount of a low-pitched sound, and is configured by one variable resistor driving unit or two variable resistor driving units, and most of guitar effectors include the same.

The distortion part 530, which adjusts a degree of distortion for expressing a characteristic tone of the corresponding effector, is most important and is represented as various names.

There is one distortion part 530, the degree of distortion is adjusted by one variable resistor driving unit (knob). In case of the overdrive effector, the distortion part 530 is represented as drive (see FIG. 1), and in case of the distortion effector, the distortion part 530 is represented as dist (see FIG. 2).

There are a plurality of distortion parts 530, 1) a scheme in which a plurality of distortion part variable resistor driving units 530*a*, 530*b* and 530*c* are mounted (see FIGS. 4, 5 and 9), 2) a scheme in which a separate mode switch 550 is mounted and a distortion part variable resistor driving unit 530 adjusts degrees of distortion in different modes through mode switching based on the mode switch 550 (see FIG. 3), and 3) a scheme in which these schemes are mixed (see FIGS. 6, 7 and 8) are used.

In case of the reverb effector, a scheme in which the distortion part 530 is represented as time and a separate mode switch 550 is mounted is used (see FIG. 3).

In case of the delay effector, a scheme in which a plurality of distortion part variable resistor driving units 530*a*, 530*b* and 530*b* are represented as repeat, rate, echo and intensity, respectively, and the distortion part variable resistor driving units are individually adjusted is used (see FIG. 4).

In case of the chorus effector, a scheme in which a plurality of distortion part variable resistor driving units 530*a* and 530*b* are represented as rate and depth, respectively, and the distortion part variable resistor driving units are individually adjusted is used (see FIG. 5).

In case of the phaser effector, a mixed scheme in which a plurality of distortion part variable resistor driving units 530*a*, 530*b* and 530*c* are represented as rate, depth and res, respectively, and a separate mode switch 550 is mounted in addition to the same is used (see FIG. 6).

In case of the wah effector, a mixed scheme in which a plurality of distortion part variable resistor driving units 530*a*, 530*b* and 530*c* are represented as decay, manual and sense, respectively, and a separate mode switch 550 is mounted in addition to the same is used (see FIG. 7).

In case of the octaver effector, a mixed scheme in which a plurality of distortion part variable resistor driving units 530*a* and 530*b* are represented as oct1 level and oct2 level, respectively, and a separate mode switch 550 is mounted in addition to the same is used (see FIG. 8).

In case of the compressor effector, a scheme in which a plurality of distortion part variable resistor driving units 530*a* and 530*b* are represented as attack and sustain, respectively, and are individually adjusted is used.

Meanwhile, when a guitar is played, a player generally uses a plurality of tones even in the same song, and a plurality of combinations of the compactors are required to obtain the tones, respectively.

To achieve this, various combinations are formed by connecting a plurality of compactors in advance and switching on/off the compactors by a foot switch during playing, so that desired tones may be obtained (because hands cannot be used due to playing of the guitar).

When some of the compactors are switched on or the other compactors are switched off, offloaded compactors are bypassed and only switched-on compactors are combined with each other, so that distorted tones may be obtained.

However, the above-described related art has the following problems.

Although compactors (effectors) may express various tones by adjustment of an adjustment unit 530, the adjustment may be performed by adjustment of a variable resistor driving unit (manipulation by hands). Thus, a real player cannot adjust the adjustment unit 530 during playing.

This is because switching-on/off of the foot switch by manipulation of a foot as described above is the only scheme capable of controlling a plurality of compactors during playing by a player.

Thus, the player adjusts adjustment units of the compactors in advance before playing, and has no choice but to control the compactors merely by switching on/off the same during the playing. Thus, there are a lot of limitations in obtaining desired tones.

For example, in playing one song, a combination of the distortion effector and the chorus effector are required at backing (accompaniment) (see FIG. 11), a combination of the distortion effector and the delay effector is required at solo performance (see FIG. 12), and the level part (level) or the distortion part (dist) should be larger adjusted at the solo performance as compared with the backing.

However, in the related art, because the level part (level) and the distortion part (dist) of the distortion effector are adjusted to be constant and only whether the chorus effector and the delay effector are combined with each other may be changed, there is a problem in that it is difficult to obtain a desired tone.

SUMMARY OF THE INVENTION

The present disclosure has been made in an effort to solve the above-mentioned problems, and an aspect of the present disclosure is to provide a guitar effector that enables a guitar player to obtain various desired tones only through manipulation of a foot switch during playing.

To solve the above problems, the present disclosure provides a guitar effector including: an input unit 3 that receives an input signal from a guitar 1 or another guitar effector; an output unit 4 that transmits an output signal to an amplifier 2 or the second guitar effector; and an adjustment unit 500 that is installed between the input unit 3 and the output unit 4 to adjust a volume and a tone based on the output signal by using a variable resistor in an analogue circuit, wherein the adjustment unit 500 includes one or more of a level part 510 that adjusts a size of the output signal, a tone part 520 that adjusts an amount of high-pitched sound and an amount of low-pitched sound, and a distortion part 530 that adjusts a degree of distortion, one or more of the level part, the tone part and the distortion part are plural, and a switch 540 including one or more of a level switch 541 for selecting any one of the plurality of level parts, a tone switch 542 for selecting any one of the plurality of tone parts, and a distortion switch 543 for selecting any one of the plurality of distortion parts is installed.

The adjustment unit 500 includes the plurality of level parts 510, and the level switch 541 for selecting any one of the plurality of level parts 510 is installed.

The adjustment unit 500 includes the plurality of tone parts 520, and the tone switch 542 for selecting any one of the plurality of tone parts 520 is installed.

The adjustment unit 500 includes the plurality of distortion parts 530, and the distortion switch 543 for selecting any one of the plurality of distortion parts 530 is installed.

The present disclosure provides a multi-type guitar effector in which a plurality of guitar effector modules 100 are installed, each of the guitar effector modules including: a component circuit board 110 on which a component circuit for an analogue guitar effector is formed; a module case 130 on which an adjustment unit 500 that adjusts a volume or a tone based on an output signal by a variable resistor in the component circuit mounted and in which the component circuit board 110 is installed as well; and a circuit connection unit 120 in which a circuit input part 121, a circuit output part 122 and a circuit power supply part 123 for the component circuit are formed and which is electrically connected to the component circuit board 110 and is installed outside the module case 130 as well, wherein the adjustment unit 500 includes one or more of a level part 510 that adjusts a size of the output signal, a tone part 520 that adjusts an amount of high-pitched sound and an amount of low-pitched sound, and a distortion part 530 that adjusts a degree of distortion, and one or more of the level part 510, the tone part 520 and the distortion part 530 are plural, and the multi-type guitar effector including: a body 210 in which a module mounting space 211 for mounting the plurality of guitar effector modules 100 is formed; a plurality of opened parts 212 that are formed on an upper surface of the body 210 to have a shape corresponding to one or the plurality of module cases 130 such that the plurality of module cases 130 are installed therein; a plurality of body connection units in which body input parts 221, body output parts 222, and body power supply parts 223 are formed to be connected to the circuit input parts 121, the circuit output parts 122, and the circuit power supply parts 123 of the plurality of circuit connection units, respectively; a body circuit board 230 which is connected to the plurality of body connection units 220, on which a body circuit mounting space 213 of the body 210 is mounted, and in which a body circuit is formed as well; an input terminal 201 that is formed in the body 210 to receive an input signal from a guitar 1 and is connected to the body circuit as well; an output terminal 202 that is formed in the body 210 to transmit an output signal to an amplifier 2 and is connected to the body circuit as well; and a plurality of switches 240 that are installed in the body 210 or a separate device connected to the body 210 to switch on or off the entirety or some of the plurality of component circuits and to select any one of the plurality of level parts 510, select any one of the plurality of tone parts 520 or select any one of the plurality of distortion parts 530 of the plurality of component circuits as well, wherein the body circuit performs a control such that the input signal received through the input terminal 201 is distorted by sequentially passing through the plurality of component circuits and the distorted signal is distorted through the output terminal 202.

The adjustment unit 500 includes the plurality of level parts 510, and the switch 240 performs a control such that any one of the plurality of level parts 510 is selected.

The adjustment unit 500 includes the plurality of tone parts 520, and the switch 240 performs a control such that any one of the plurality of tone parts 520 is selected.

The adjustment unit 500 includes the plurality of distortion parts 530, and the switch 240 performs a control such that any one of the plurality of distortion parts 530 is selected.

The body circuit performs a control such that the input signal received through the input terminal 201 is transmitted to the circuit input parts 121 of the plurality of circuit connection units 120 through the body output parts 222 of the plurality of body connection units 220, respectively, and the signal distorted by the plurality of component circuits is transmitted to the body input parts 221 of the plurality of body connection units 220 through the circuit output parts 122 of the plurality of circuit connection units 120, respectively, and is output through the output terminal 202.

BRIEF DESCRIPTION OF THE DRAWINGS

The above and other objects, features and advantages of the present invention will be more apparent from the following detailed description in conjunction with the accompanying drawings, in which:

FIG. 13 is a plan view of a first embodiment of a compactor;

FIGS. 14 and 15 are use state views of the first embodiment of the compactor;

FIG. 16 is a plan view of a second embodiment of a compactor;

FIG. 17 is a plan view of a third embodiment of a compactor;

FIG. 18 is a plan view of a fourth embodiment of a compactor;

DETAILED DESCRIPTION OF THE EXEMPLARY EMBODIMENTS

Figure 1:
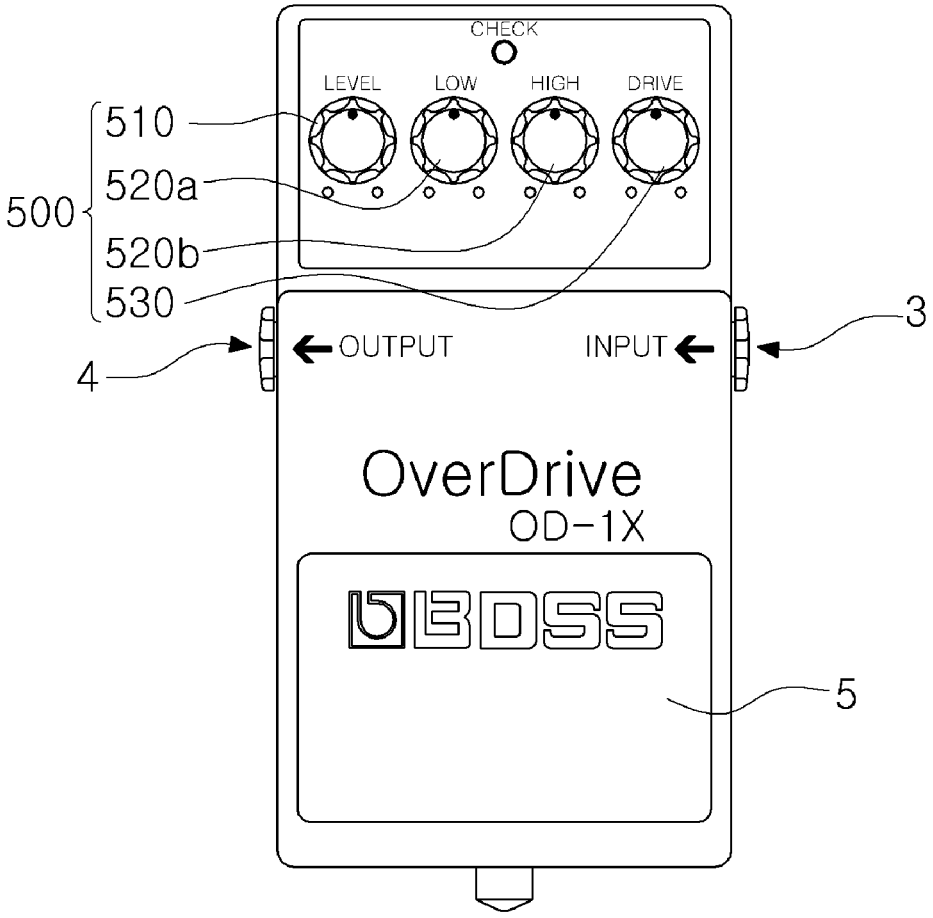
FIG. 1 Prior Art
FIGS. 1 to 10 are plan views illustrating types of compactors according to the related art.

Hereinafter, embodiments of the present disclosure will be described in detail with reference to the accompanying drawings.

The present disclosure relates to a guitar effector (compactor and multi-type guitar effector), FIGS. 13 to 18 relate to embodiments of a compactor, and FIGS. 19 to 23 relate to a multi-type guitar effect.

Embodiments illustrated in FIGS. 13 to 18 relate to a compactor including: an input unit 3 that receives an input unit from a guitar 1 or another guitar effector; an output unit 4 that transmits an output signal to an amplifier 2 or the second guitar effector; and an adjustment unit 500 that is installed between the input unit 3 and the output unit 4 to adjust a volume or a tone based on the output signal by a variable resistor in an analogue circuit.

Here, the adjustment unit 500 includes one or more of a level part 510 that adjusts a size of an output signal, a tone part 520 that adjusts an amount of a high-pitched sound and an amount of a low-pitched sound, and a distortion part 530 that adjusts a degree of distortion, and one or more of the level part 510, the tone part 520 and the distortion part 530 are plural.

Further, a switch 540 including one or more of a level switch 541 for selecting any one of the plurality of level parts 510, a tone switch 542 for selecting any one of the plurality of tone parts 520, and a distortion switch 543 for selecting any one of the plurality of distortion parts 530 is installed. That is, one or more of the level part 510, the tone part 520, and the distortion part 530 are plural, and the switch 540 for selecting any one of the plurality of level parts 510, selecting any one of the plurality of tone parts 520 and selecting any one of the plurality of distortion parts 530 is additionally installed.

Here, the switch 540 is also installed to have a foot switch structure to enable manipulation during playing.

Figure 13:
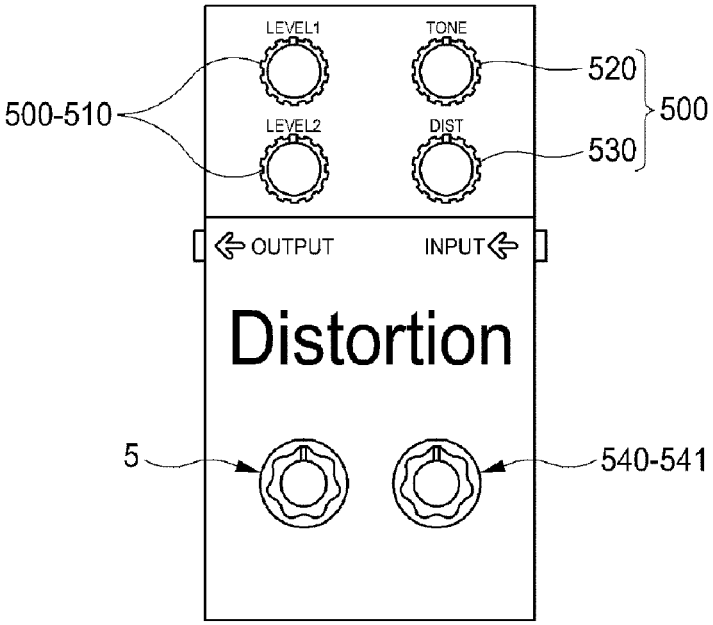
FIGS. 13 to 18 illustrate embodiments of the present disclosure.

As illustrated in FIG. 13, a case where the plurality of level parts 510 are installed as the adjustment unit 500 and the level switch 541 for selecting any one of the plurality of level parts 510 is installed is illustratively described below.

As exemplified in the above-described related art, the description will be made on the premise that in playing one song, a combination of the distortion effector and the chorus effector is required at backing (accompaniment) and a combination of the distortion effector and the delay effector is required at solo performance (the level part (level) or the distortion effector (dist) should be larger adjusted during the solo performance as compared with the backing).

Before playing starts, in a state in which the distortion effector is connected to the chorus effector and the delay effector, a player sets one (level 1) of the plurality of level parts 510 to be small and sets the other one (level 2) to be large.

Figure 14:
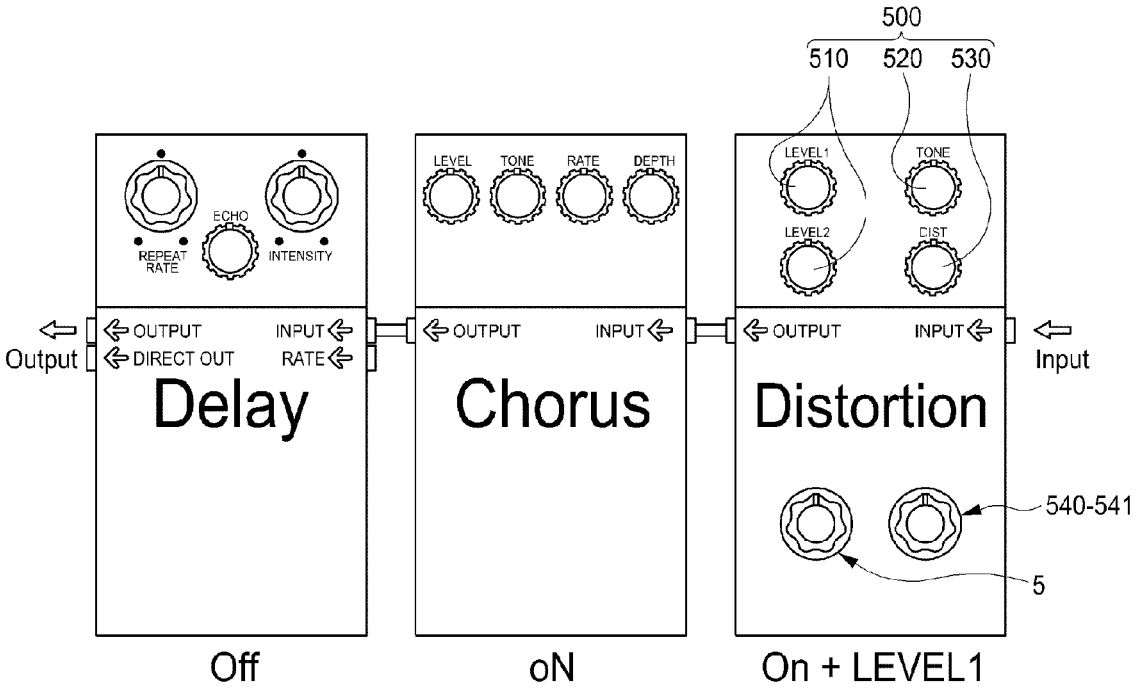

When backing is performed during the playing, only the distortion effector and the chorus effector are switched on by a foot switch 5 and one (level 1) of the plurality of level parts (510) may be selected by manipulating the level switch 541 by also a foot as well (see FIG. 14).

Figure 15:
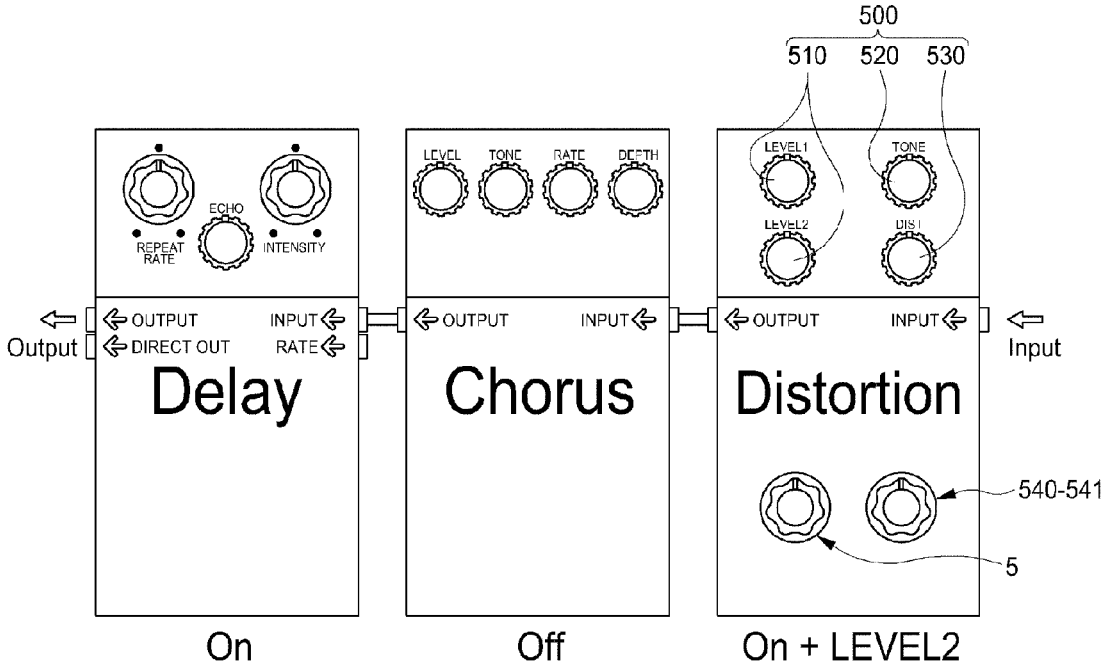

When solo performance is performed during the playing, only the distortion effector and the delay effector are switched on by the foot switch and the other one (level 2) of the plurality of level parts 510 may be selected by manipulating the level switch 541 by also the foot (see FIG. 15).

Thus, even when the player cannot use his/her hands during the playing, the same effect as an effect that is obtained by adjusting a variable resistor driving part of the adjustment unit (dist) in one guitar effector (the distortion effector) by hands may be obtained only though manipulation of the foot.

The level switch 541 may be implemented separately from the foot switch 5 for switching-on/off and may be implemented by one switch.

For example, the level switch 541 may be implemented such that when one switch is stepped on once, this corresponds to "switching-on+level 1", when the switch is stepped on twice, this corresponds to "switching-on+level 2", and when the switch is stepped three times, this corresponds to "switching-off".

In the present embodiment, a circuit may be implemented such that variable resistors corresponding to the plurality of level parts 510 (level 1 and level 2), respectively, are configured in a parallel circuit and the level switch 541 alternatively selects the plurality of above variable resistors.

Further, as described above, because the present disclosure is made on the premise that not a digital circuit but an analogue circuit (having excellent sound quality) is used, the circuit that is configured to alternatively select the plurality of above variable resistors may obtain the above-described functions even while obtaining excellent sound quality.

Figure 16:
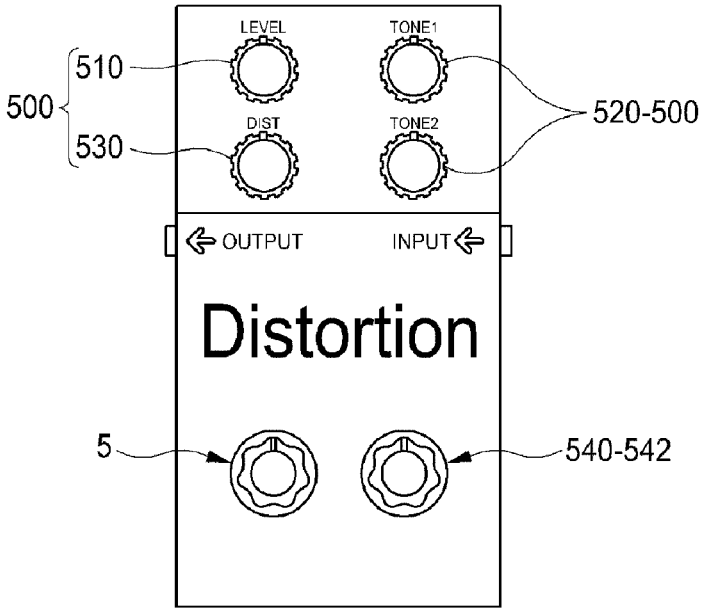

As illustrated in FIG. 16, a case where the plurality of tone parts 520 are installed as the adjustment unit 500 and the tone switch 542 for selecting any one of the plurality of tone parts 520 is installed will be illustratively described below.

As exemplified above, the description will be made on the premise that in playing one song, a combination of the distortion effector and the chorus effector is required at backing (accompaniment) and a combination of the distortion effector and the delay effector is required at solo performance (the level part (level) or the distortion effector (dist) should be larger adjusted during the solo performance as compared with the backing).

Before playing starts, in a state in which the distortion effector is connected to the chorus effector and the delay effector, a player sets one (tone 1) of the plurality of tone parts 520 to be small and sets the other one (tone 2) to be large.

When backing is performed during the playing, only the distortion effector and the chorus effector are switched on by a foot switch and one (tone 1) of the plurality of tone parts (520) may be selected by manipulating the tone switch 542 by also a foot as well.

When solo performance is performed during the playing, only the distortion effector and the delay effector are switched on by the foot switch and the other one (level 2) of the plurality of tone parts 520 may be selected by manipulating the tone switch 542 by also a foot as well.

Thus, even when the player cannot use his/her hands during the playing, the same effect as an effect that is obtained by adjusting a variable resistor driving part of the adjustment unit (tone) in one guitar effector (the distortion effector) by hands may be obtained only though manipulation of the foot.

Figure 2:
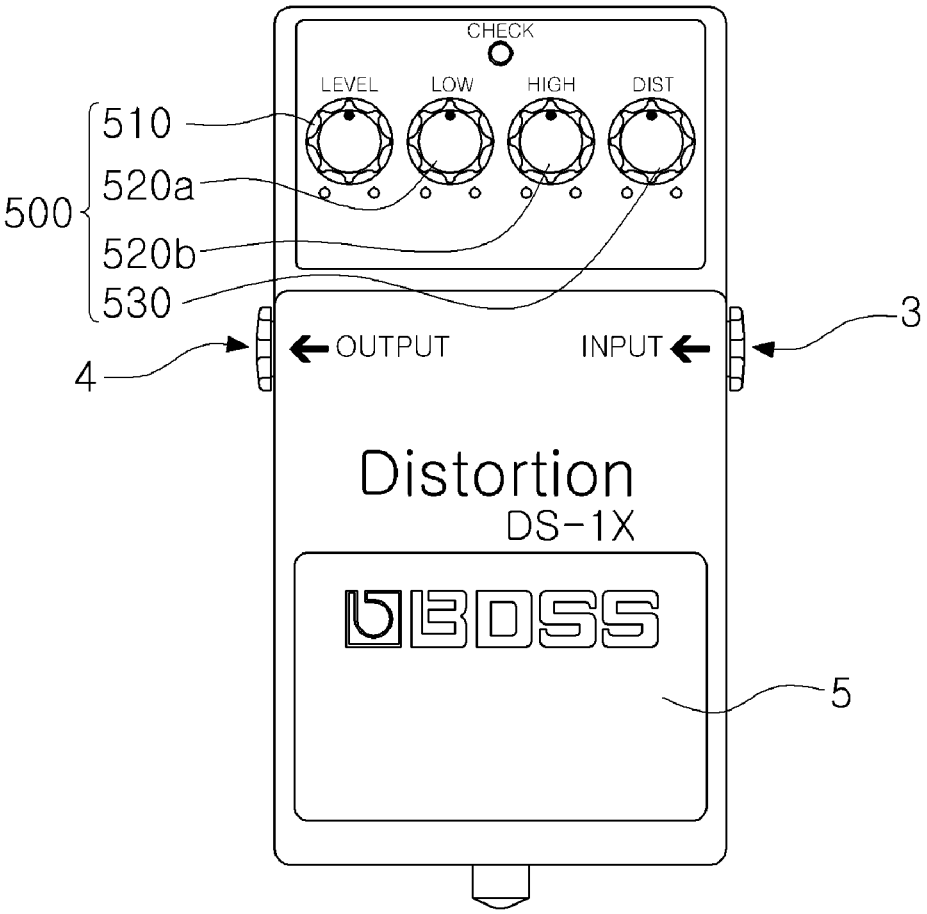
FIG. 2 Prior Art

In the effector according to the related art, two kinds of tone parts 520 (low and high) are installed (see FIGS. 1 and 2). Because this relates to "dissimilar tone parts" in which a tone part 520*a* for a low-pitched sound and a tone part 520*b* for a high-pitched sound are separated from each other and the plurality of tone parts according to the present disclosure means homogeneous tone parts, both cases are completely different.

Figure 3:
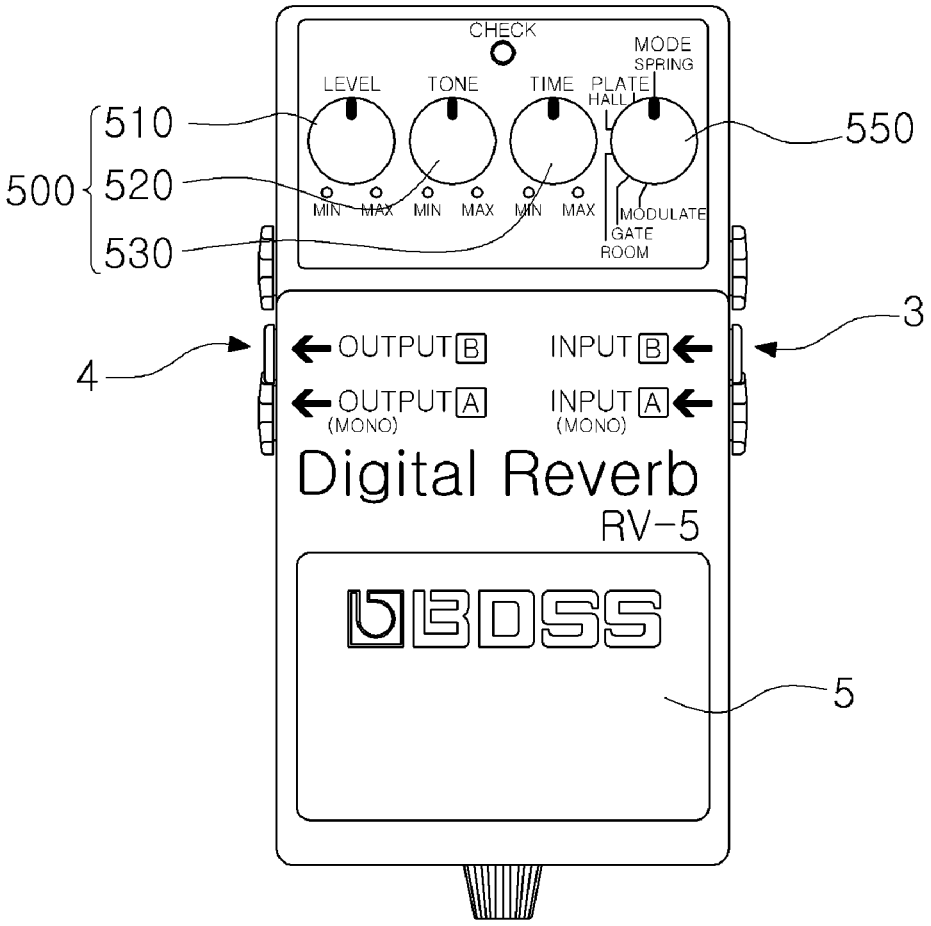
FIG. 3 Prior Art
Figure 4:
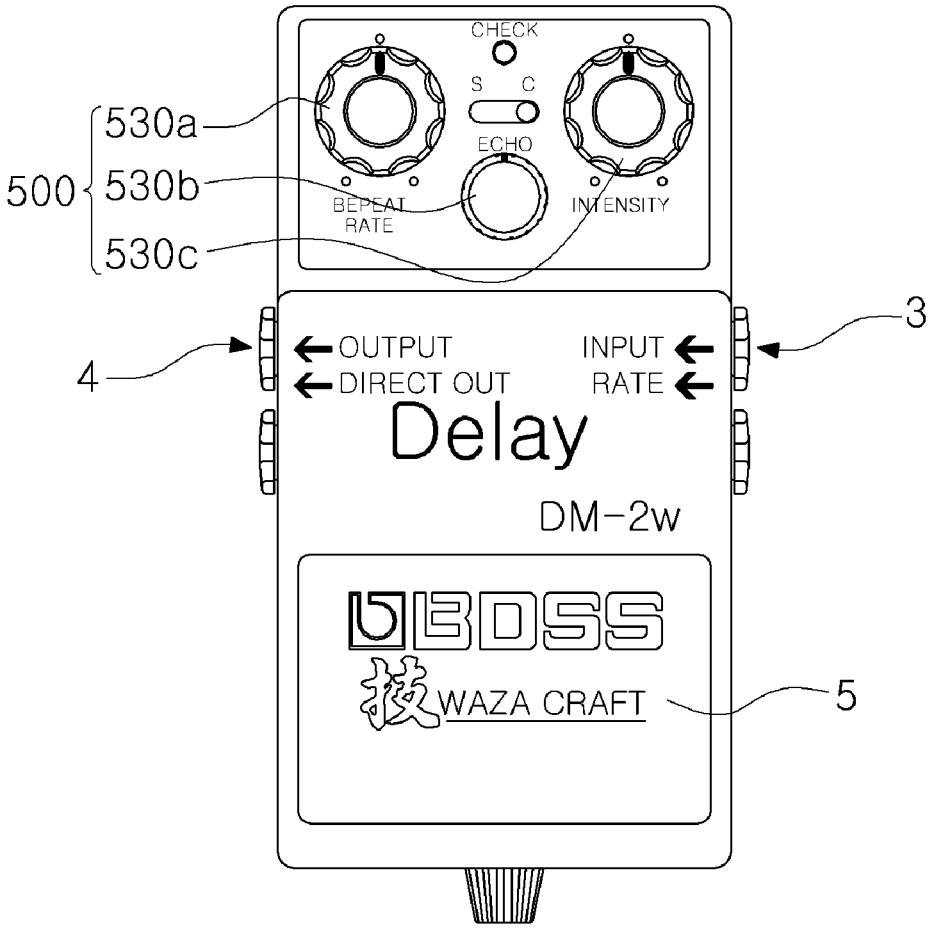
FIG. 4 Prior Art
Figure 5:
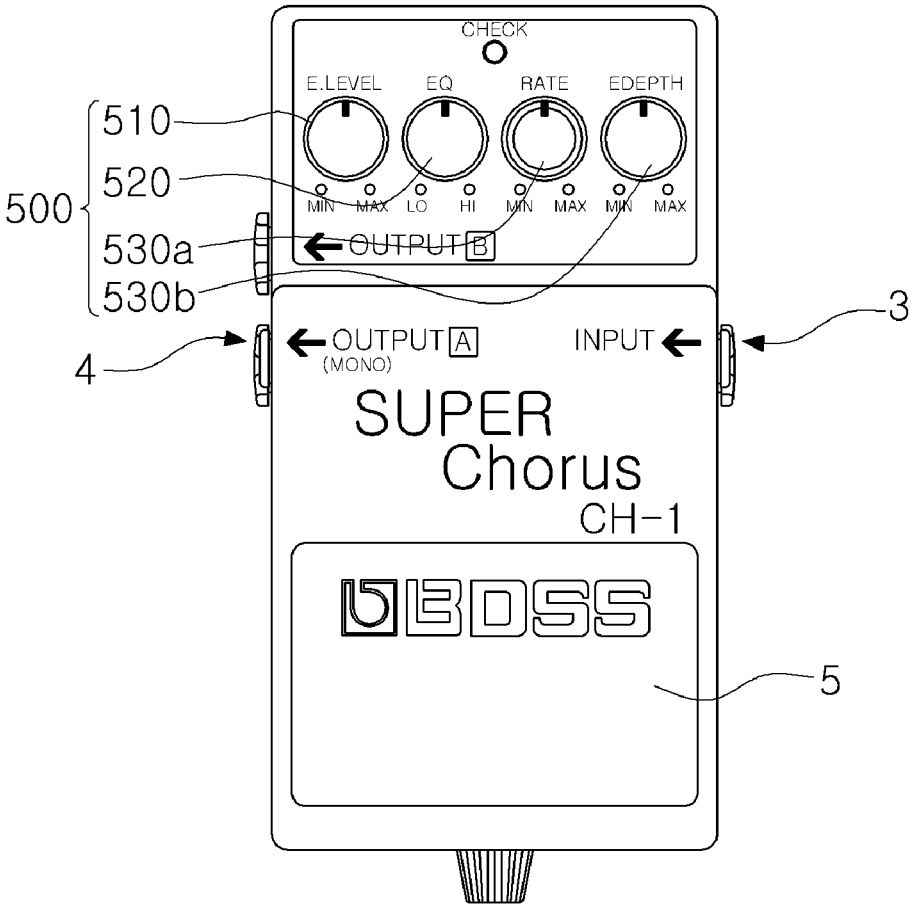
FIG. 5 Prior Art
Figure 6:
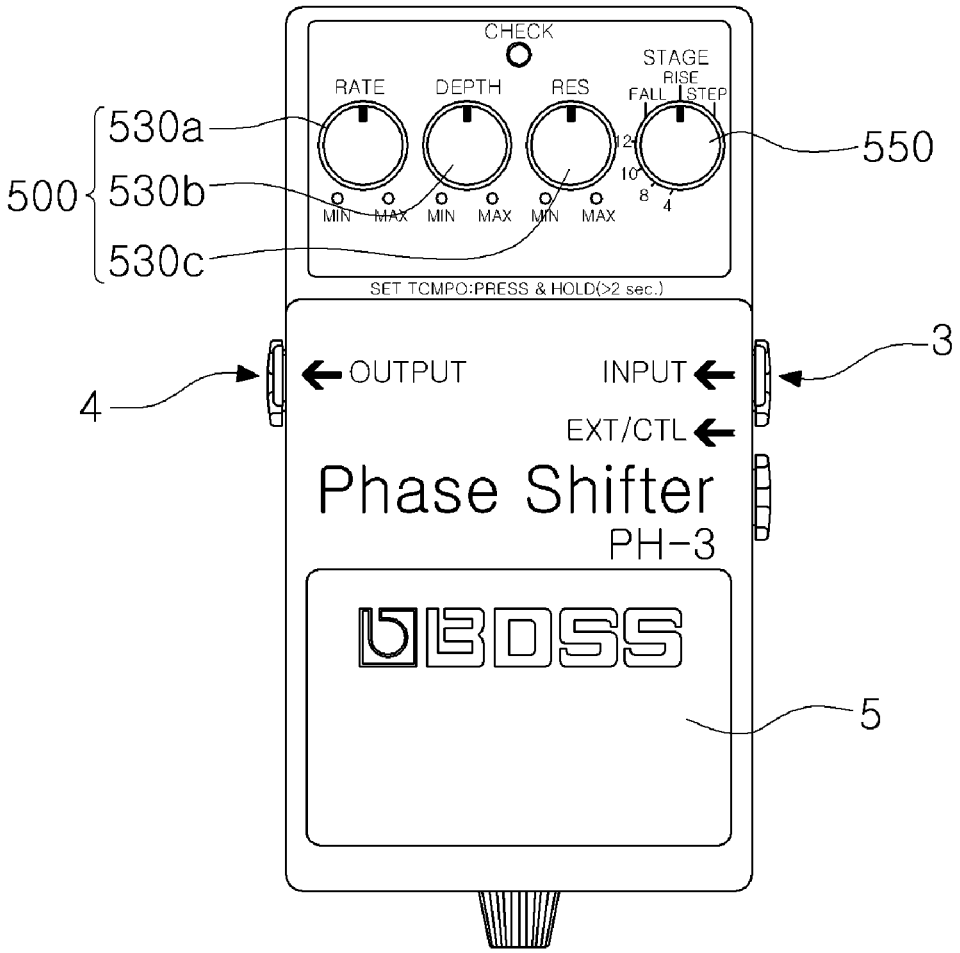
FIG. 6 Prior Art
Figure 7:
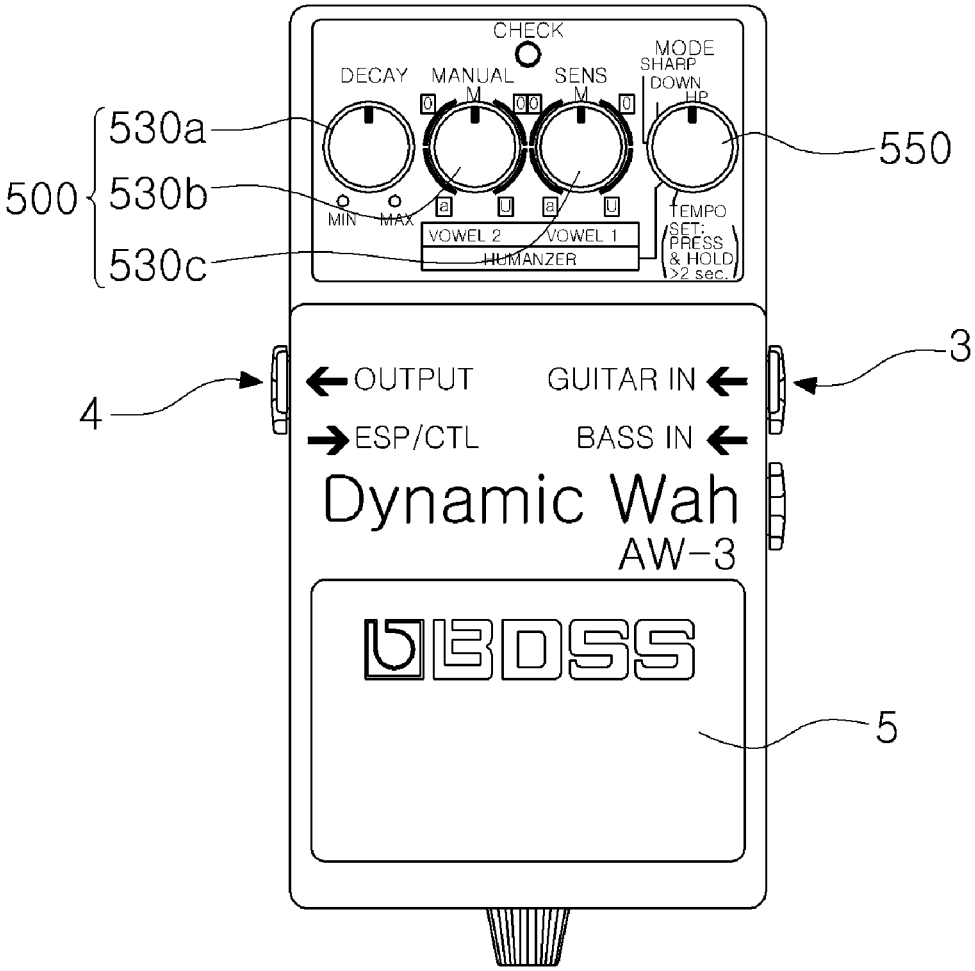
FIG. 7 Prior Art
Figure 8:
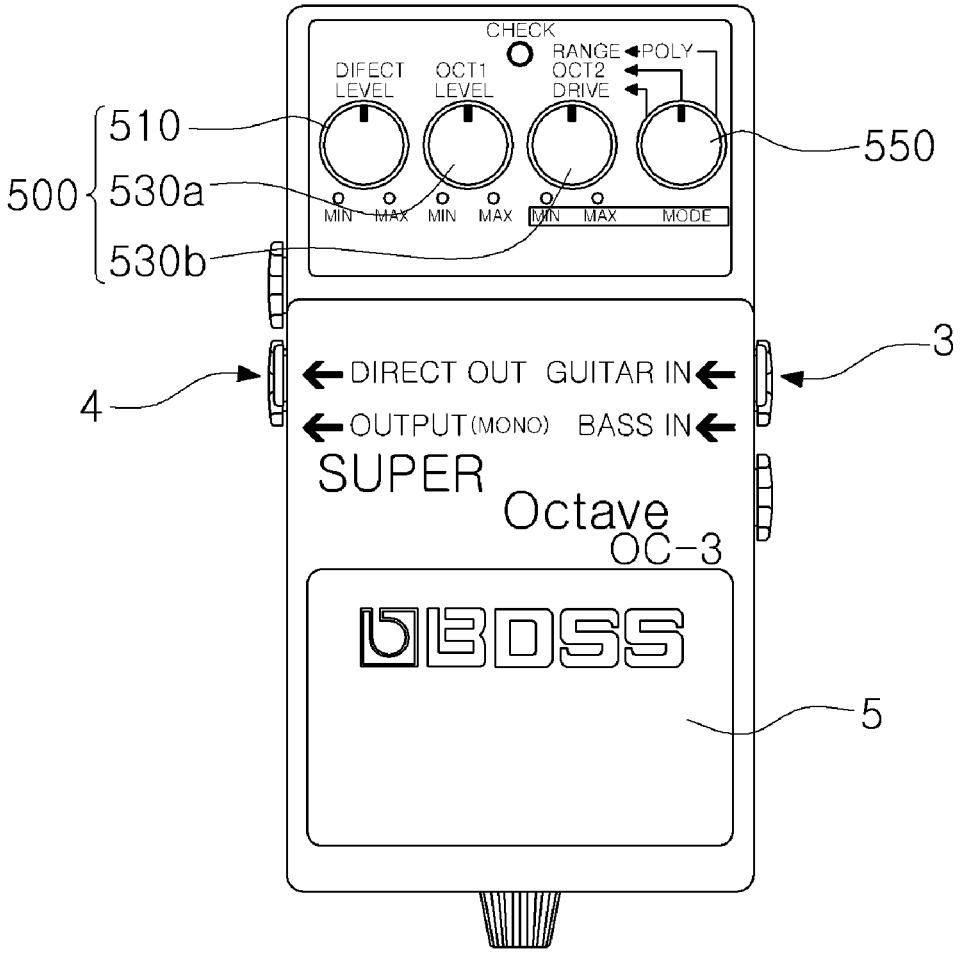
FIG. 8 Prior Art
Figure 9:
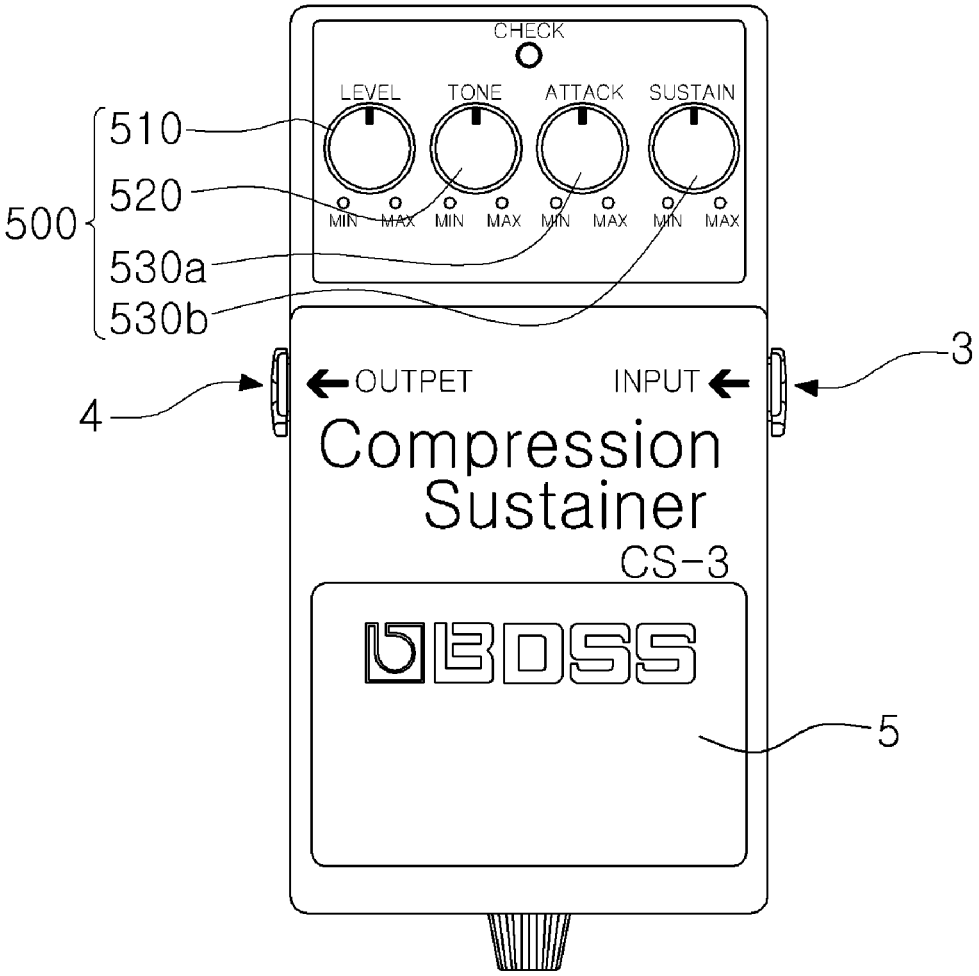
FIG. 9 Prior Art
Figure 10:
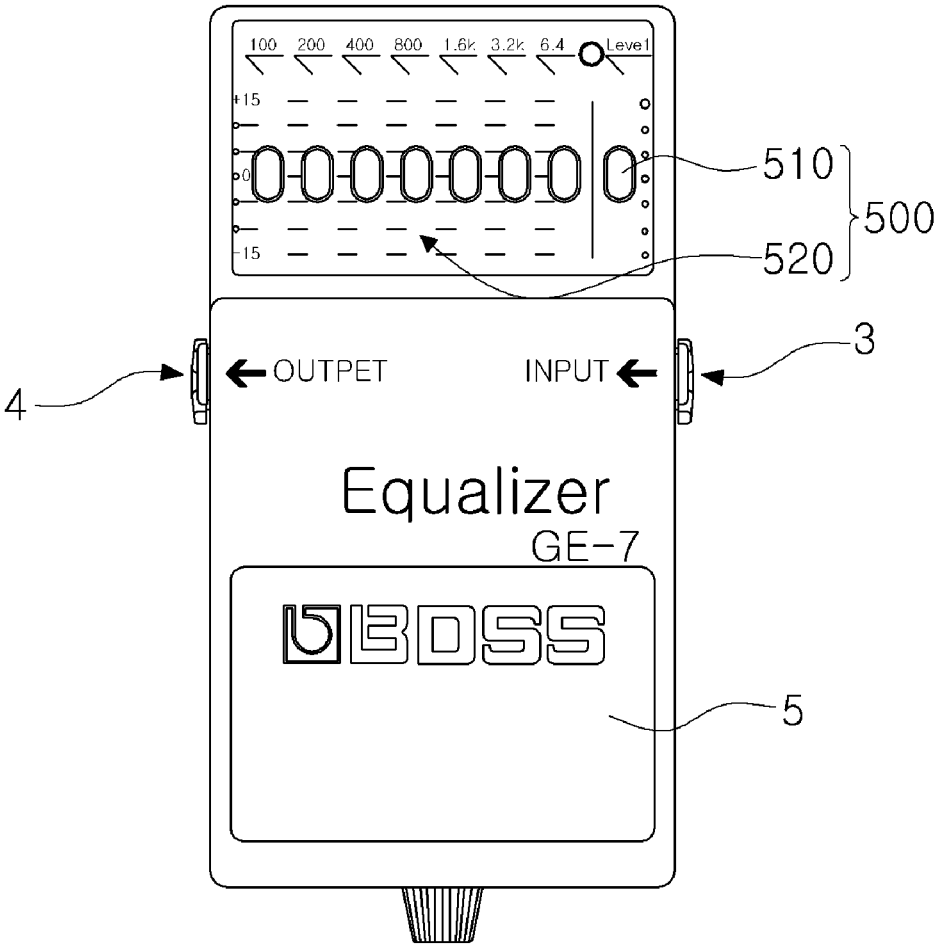
FIG. 10 Prior Art
Figure 11:
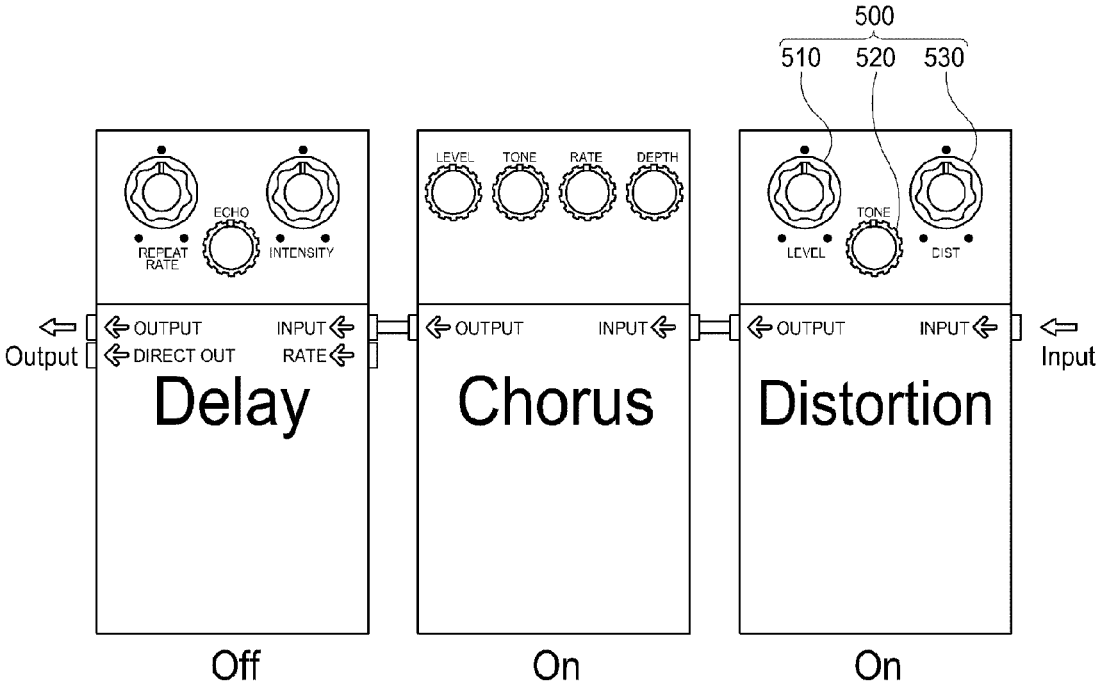
FIG. 11 Prior Art
FIGS. 11 and 12 are use state views illustrating compactors according to the related art.
Figure 12:
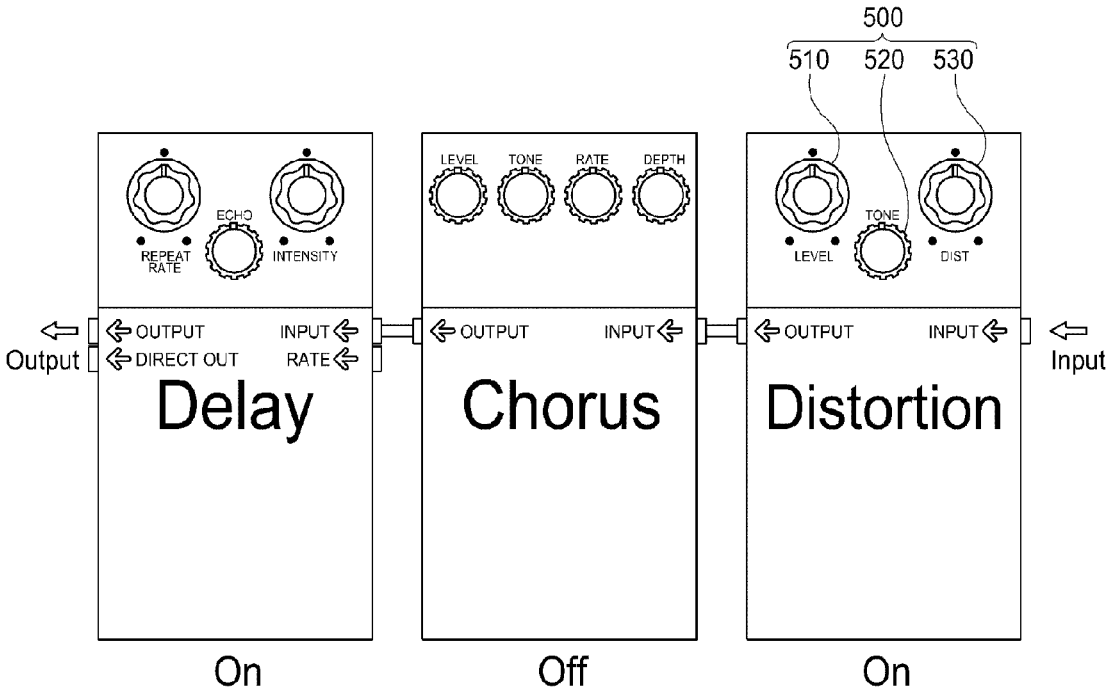
FIG. 12 Prior Art

That is, the present disclosure corresponds to a concept of adding one tone part as illustrated in FIGS. 3, 5 and the like to the same one tone part.

When the present disclosure is applied to the effector in which a plurality of dissimilar tone parts are installed as illustrated in FIGS. 1 and 2, each of the tone parts (the tone part 520*a* for a low-pitched sound and the tone part 520*b* for a high-pitched sound) is pluralized and a plurality of tone switches are installed according thereto.

In the present embodiment, a circuit may be implemented such that variable resistors corresponding to the plurality of tone parts 520 (tone 1 and tone 2), respectively, are configured in a parallel circuit and the tone switch 542 alternatively selects the plurality of above variable resistors.

Figure 17:
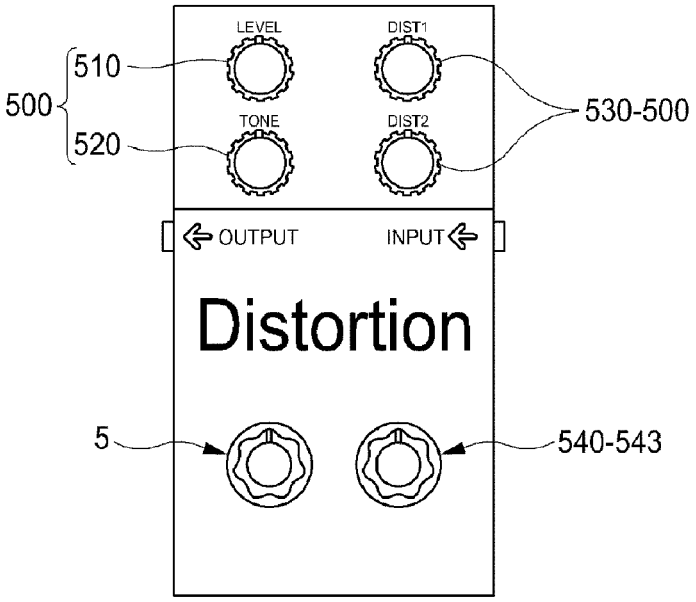

As illustrated in FIG. 17, even when the plurality of distortion parts 530 are installed as the adjustment unit 500 and the distortion switch 543 for selecting any one of the plurality of distortion parts 530 is installed, the same effect as those of the above two embodiments may be obtained.

In the effector according to the related art, the plurality of distortion parts 530 are installed as illustrated in FIGS. 3 to 9. Because this also relates to "dissimilar distortion parts" which have different characteristics of distortion and the plurality of distortion parts according to the present disclosure mean "homogeneous distortion parts" having the same characteristics of distortion, both cases are completely different.

That is, the present disclosure corresponds to a concept of adding one distortion part as illustrated in FIGS. 1, 2 and the like to the same one distortion part.

In the present embodiment, a circuit may be implemented such that variable resistors corresponding to the plurality of distortion parts 530 (dist 1 and dist 2), respectively, are configured in a parallel circuit and the tone switch 542 alternatively selects the plurality of variable resistors.

When the present disclosure is applied to the effector in which a plurality of dissimilar distortion parts are installed as illustrated in FIGS. 3 to 9, each of the dissimilar distortion parts is pluralized and a plurality of distortion switches are installed according thereto.

Figure 18:
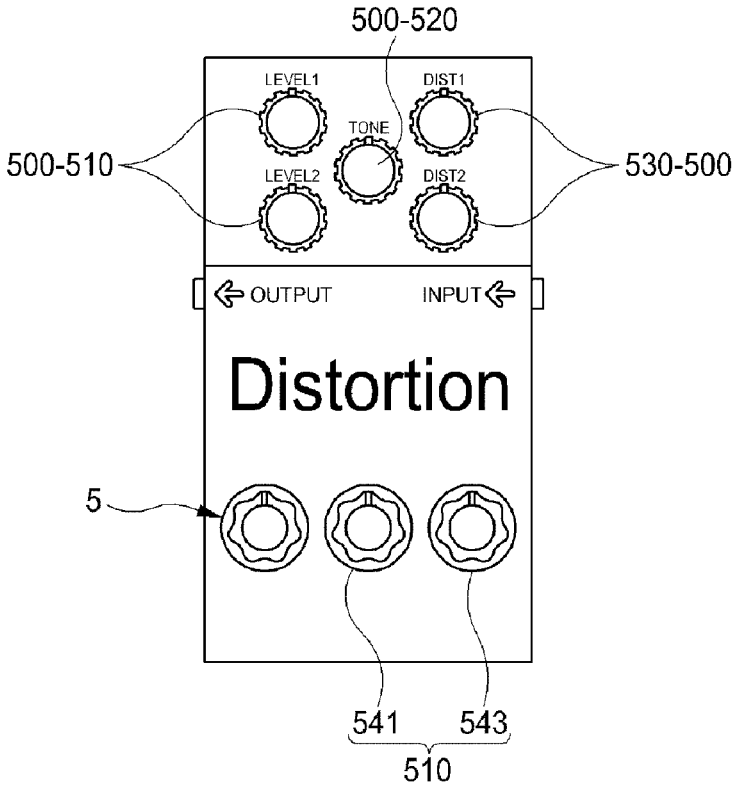

FIGS. 13 to 17 relate to embodiments in which only any one of the level part 510, the tone part 520 and the distortion part 530 that constitute the adjustment unit 500 is plural, and FIG. 18 relates to an embodiment in which two or more of the level part 510, the tone part 520 and the distortion part 530 are plural.

That is, each of the level part 510 and the distortion part 530 are plural, and the level switch 541 and the distortion switch 543 for switching them, respectively, are installed.

As described above, the level switch 541 and the distortion switch 543 may be implemented separately from the foot switch 5 for switching-on/off or may be implemented by one switch.

For example, the level switch 541 and the distortion switch 543 may be implemented such that when one switch is stepped on once, this corresponds to "switching-on+level 1+dist 1", when the switch is stepped on twice, this corresponds to "switching-on+level 2+dist2", and when the switch is stepped three times, this corresponds to "switching-off".

Hereinafter, a multi-type guitar effector according to the present disclosure will be described with reference to FIGS. 19 to 23.

The multi-type guitar effector according to the present disclosure is basically configured such that a plurality of guitar effector modules 100 are detachably installed in the body 210.

Figure 19:
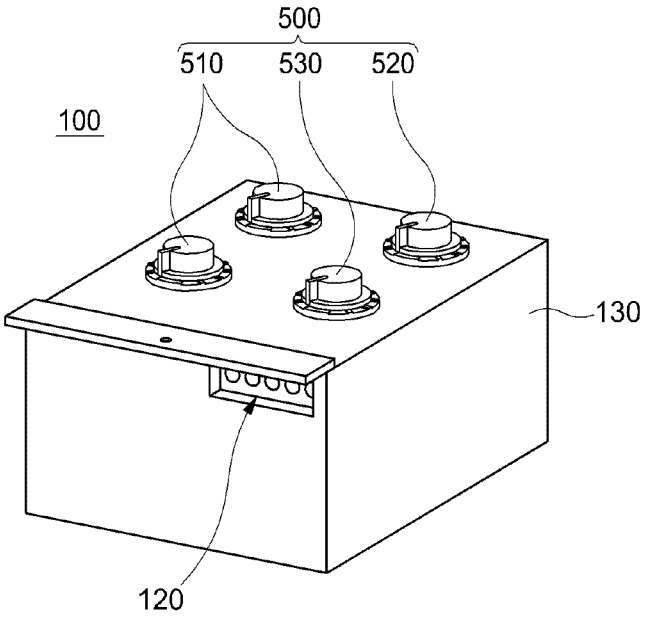
FIG. 19 is a perspective view illustrating a guitar effector module.

Each guitar effector module 100 includes: a component circuit board 110 on which an analogue component circuit for a guitar effector is formed; a module case 130 on which an adjustment unit 500 that adjusts a volume or a tone based on an output signal by variable resistors in a component circuit and in which the component circuit board 110 is installed; and a circuit connection unit 120 in which a circuit input part 121, a circuit output part 122 and a circuit power supply part 123 are formed and which is electrically connected to the component circuit board 110 and is installed outside the module case 130 (see FIG. 19).

Here, the adjustment unit 500 includes one or more of a level part 510 that adjusts a size of an output signal, a tone part 520 that adjusts an amount of a high-pitched sound and an amount of a low-pitched sound, and a distortion part 530 that adjusts a degree of distortion, wherein one or more of the level part 510, the tone part 520 and the distortion part 530 are plural.

Figure 20:
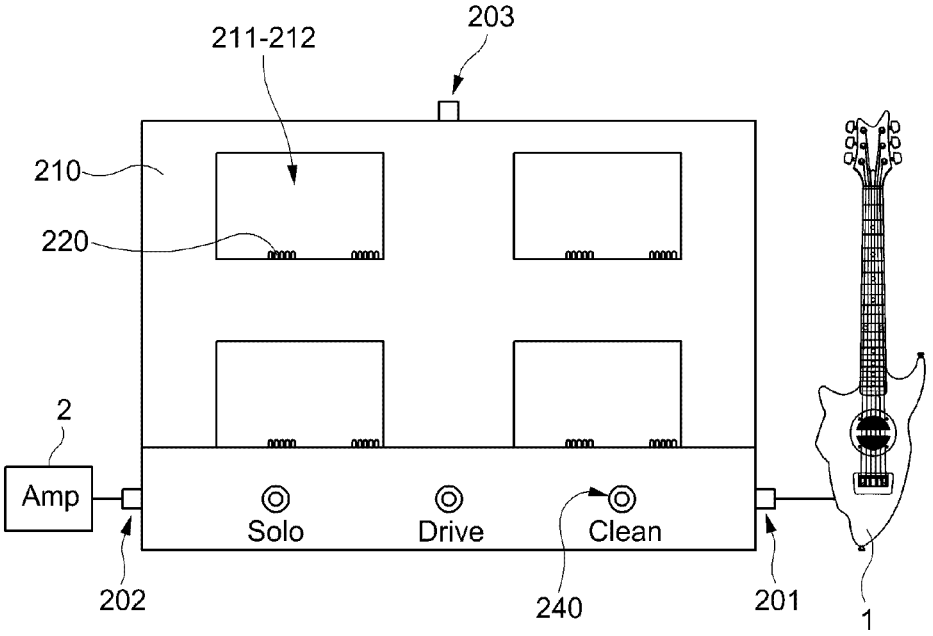
FIG. 20 is a plan view illustrating a first use state of a multi-type guitar effector.
Figure 21:
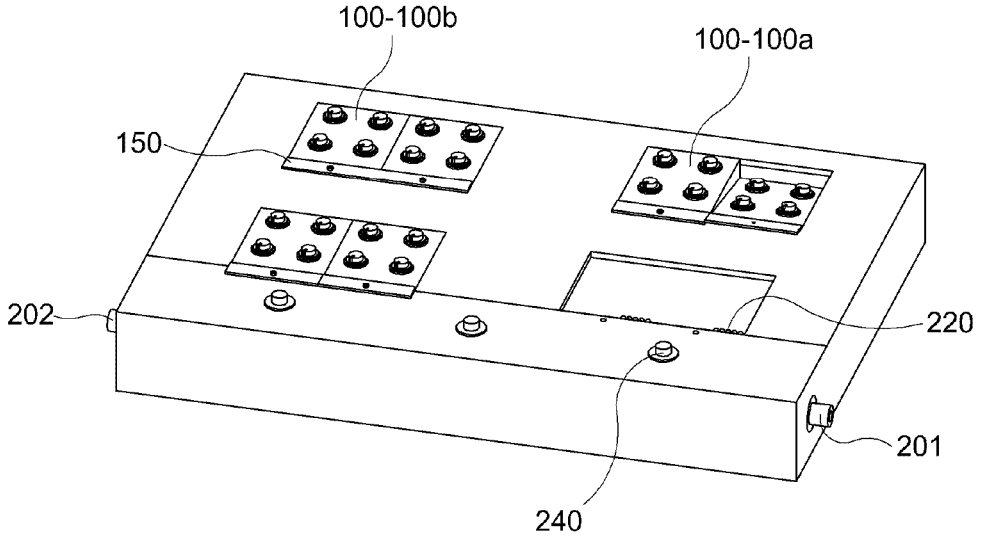
FIG. 21 is a perspective view illustrating a second use state of the multi-type guitar effector.

Such a multi-type guitar effector on which the plurality of guitar effector modules 100 are mounted comprises: the body 210 in which a module mounting space 211 for mounting the plurality of guitar effector modules 100 is formed; a plurality of opened parts 212 that are formed on an upper surface of the body 210 to have a shape corresponding to one or a plurality of module cases 130 such that the plurality of module cases 130 are installed therein; a plurality of body connection units 220 in which body input parts 221, body output parts 222 and body power supply parts 223 are formed to be connected to circuit input parts 121, circuit output parts 122 and circuit power supply parts 123 of a plurality of circuit connection units 120, respectively; a body circuit board 230 which is connected to the plurality of body connection parts 220 and is mounted on a body circuit mounting space 213 of the body 210 as well and in which a body circuit is formed; an input terminal 201 that is formed in the body 210 to receive an input signal from a guitar 1 and is connected to the body circuit as well; an output terminal 202 that is formed in the body 210 to transmit an output signal to an amplifier 2 and is connected to the body circuit as well; and a plurality of switches 240 that are installed in the body 210 or a separate device connected to the body 210 to switch on/off the entirety or some of a plurality of component circuits and select any one of the plurality of level parts 510, select any one of the plurality of tone parts 520 or select any one of the plurality of distortion parts 530 of the plurality of component circuits as well (see FIGS. 20 and 21).

Here, the body circuit performs a control such that the input signal received through the input terminal 201 is distorted by sequentially passing through the plurality of component circuits and the distorted signal is output through the output terminal 202.

That is, one or more of the level part 510, the tone part 520 and the distortion part 530 are plurally installed in the guitar effector module 100, and the plurality of switches 240 (foot switch) are installed in the body 210 to select ones of the plurality of level parts 510, the plurality of tone parts 520 and the plurality of distortion parts 530.

Here, the plurality of switches 240 have a function of switching on/off the entirety or some of the plurality of component circuits and select any one of the plurality of level parts 510, select any one of the plurality of tone parts 520 or select any one of the plurality of distortion parts 530 of the plurality of component circuits as well.

The "separate device connected to the body 210" in which the plurality of switches 240 are installed refers to a case where when the body 210 is not placed on the floor to be in contact with a foot of a player, a separate device in which the switches 240 are installed is placed on the floor, and the separate device is wired or wirelessly connected to the body 210.

Embodiments and effects related to configurations of the switches 240 for installation and selection of the plurality of level parts 510, the plurality of tone parts 520 and the plurality of distortion parts 530 are basically identical to the above description related to the compactor. Hereinafter, unique configurations and effects of the multi-type guitar effector will be described.

The body circuit performs a control such that the input signal received through the input terminal 201 is transferred to the circuit input parts 121 of the plurality of circuit connection units 120 through the body output parts 222 of the plurality of body connection units 220 and the signal distorted by the plurality of component circuits is transferred to the body input parts 221 of the plurality of body connection units 220 through the circuit output parts 122 of the plurality of circuit connection units 120 and is output through the output terminal 202.

Because it is preferred that a signal ground (signal GND) is separately connected to remove noise, signal GND connection parts 124 of the circuit connection units 120 are separately connected to signal GND connection parts 224 of the body connection parts 220.

For example, the input signal received through the input terminal 201 is transferred to a circuit input part 121 of a circuit connection unit 120 of a first guitar effector module 100 through a body output part 222 of a first body connection unit 220 of the body 210 and a signal distorted by a circuit of the first guitar effector module 100 is transferred to a body input part 221 of the first body connection unit 220 through a circuit output part 122 of the circuit connection unit 120, and is transferred to the body circuit again.

Such a signal of the body circuit is transferred to a circuit input part 121 of a circuit connection unit 120 of a second guitar effector module 100 through a body output part 222 of a second body connection unit 220 of the body 210 and a signal distorted by a circuit of the second guitar effector module 100 is transferred to a body input part 221 of the second body connection unit 220 through a circuit output part 122 of the circuit connection unit 120, and is transferred to the body circuit again.

A signal distorted by a circuit of a final guitar effector module 100 through this process is transferred to a body input part 221 of a final body connection unit 220 through a circuit output part 122 of a circuit connection unit 120 of the final guitar effector module 100 and is output through the output terminal 202.

That is, the multi-type guitar effector according to the present disclosure is not configured by a plurality of compactors which are separate complete products and a multi-type apparatus as in the related art, but a complete product thereof is finally obtained by coupling the plurality of guitar effector modules 100 to the body 210 of the multi-type guitar effector.

When this configuration is selected, a combination structure in which a plurality of circuits for guitar effectors are mutually coupled to each other may be achieved only by mounting the guitar effector modules 100 on the body 210 and connecting the circuit connection units 120 thereof to the body connection units 220 of the body 210. Thus, use of a plurality of cables as in the related art may be omitted, so that transport, storage, installation and use thereof are simple and convenient.

The adjustment unit 500 having a knob structure, which is adapted to adjust a level, a tone and the like, is mounted on the module case 130, and the module case 130 is coupled to an opened part 212 of the body 210, so that an effector circuit of the corresponding component assembly may be adjusted by the above adjustment unit 500.

A catching part 150 that protrudes outward from an upper portion of the module case 130 and is upward stepped is formed in the module case 130. While an upper surface of the guitar effector module 100 having such a structure is exposed to the above opened part 212 through a lower opened portion of the body 210, when the catching part 150 is caught by an edge of the opened part 212 of the body 210, and the lower opened portion of the body 210 is coupled (screw-coupled or the like) through a separate closed plate 250, simple, convenient, and stable coupling may be achieved (see FIG. 23).

When a coupling hole 151 is formed in the catching part 150 and a screw member or the like is coupled to the body 210 through this, more stable coupling may be achieved.

The opened part 212 of the body 210 is formed to have a shape corresponding to one or the plurality of module cases 130. When the opened part 212 is formed to have a shape corresponding to the plurality of module cases 130, a plurality of small guitar effector modules 100*a* may be installed in one opened part 212 (see FIG. 20).

It is preferred for stable mounting of the guitar effector modules 100 that the body connection units 220 of the body 210 of the multi-type guitar effector protrude from lower sides of the opened parts 212 and the circuit connection units 120 of the guitar effector modules 100 are recessed to correspond to the same (see FIGS. 19 to 21).

The circuit input parts 121 for transferring input signals to circuits, the circuit output parts 122 for outputting output signals distorted by the circuit, and the circuit power supply parts 123 for supplying power to the circuits are formed in the circuit connection units 120 of the guitar effector modules 100, respectively.

Figure 22:
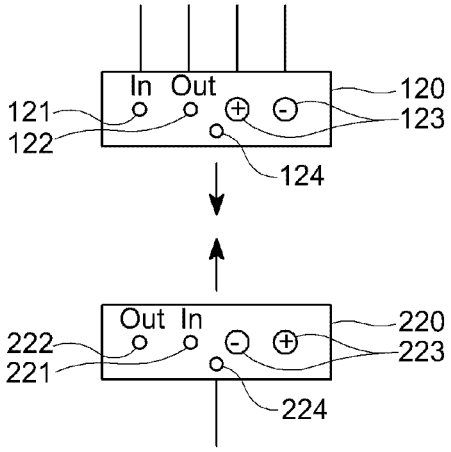
FIG. 22 is an exploded perspective view illustrating the multi-type guitar effector.
Figure 23:
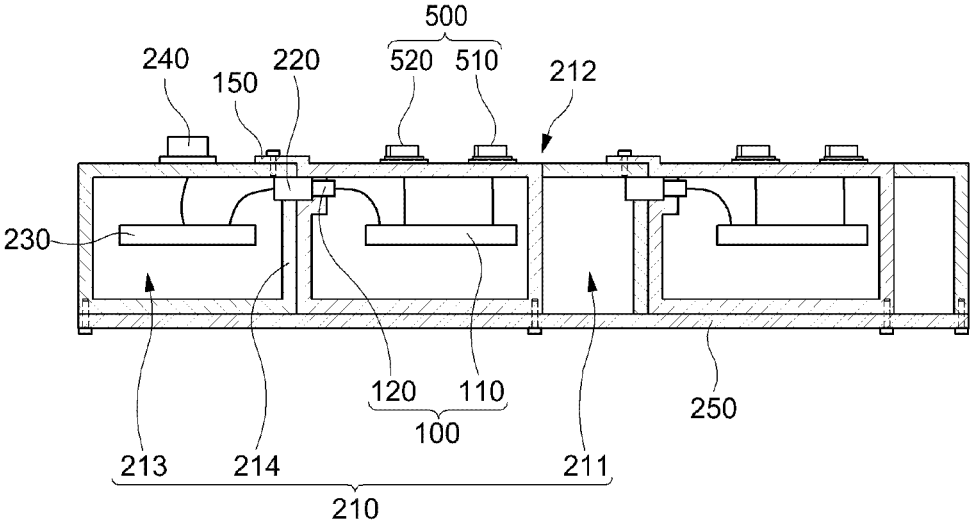
FIG. 23 is a sectional view illustrating the multi-type guitar effector.

The body input parts 221 for receiving the output signals from the circuit output parts 122, the body output parts 222 for transmitting signals of the body circuit to the circuit input parts 121 of the guitar effector modules 100, and the body power supply parts 223 for supplying power to the circuit power supply parts 123 are formed in the body connection units 220 that are connected to the circuit connection units 120, respectively (see FIG. 22).

The circuit connection units 120 of the guitar effector modules 100 and the body connection parts 220 of the body 210 may be fitted in each other by even structures, respectively. When a coupling structure in which upper surfaces of the guitar effector modules 100 are exposed through the opened parts 212 as described above is selected, a groove structure is selected as the circuit connection units 120 of the guitar effector modules 100 and a protruding structure is selected as the body connection units 220 of the body 210, so that the coupling between the body 210 and the guitar effector modules 100 and the coupling between the circuit connection units 120 and the body connection units 220 may be naturally achieved together.

The body 210 is spatially partitioned by a partition wall 214. The body circuit board 230 is mounted on the body circuit mounting space 213 of the partitioned spaces, and the guitar effector modules 100 are mounted on the module mounting space 211 on an opposite side thereto.

The body connection units 220 connected to the body circuit board 230 are exposed close to the module mounting space 211 over the partition wall 214, and the plurality of guitar effector modules 100 are coupled to each other in such a module mounting space 211.

Thus, a user may obtain a multi-type guitar effector having a desired combination only by coupling the plurality of guitar effector modules 100 to the body 210 in a desired pattern, and accordingly, coupling the circuit connection units 120 and the body connection units 220 to each other in the module mounting space 211 therein, respectively.

The input terminal 201 that is connected to the body circuit to receive the input signal from the guitar 1 and the output terminal 202 that is connected to the body circuit to transmit the output signal to the amplifier 2 are formed on one side or opposite sides of the body 210 and the plurality of switches 240 that are connected to the body circuit to switch on/off the component circuit board 110 are installed to be exposed to the upper surface of the body 210.

Here, it is preferred for convenience of use that one switch 240 is installed to switch on/off the plurality of component circuit boards 110.

The plurality of switches 240 having such a configuration are installed. When all the switches are switched on, a tone is distorted by circuits of all the component circuit boards 110, and when some of the switches are switched on and the other switches are switched off, circuits that are switched off are bypassed and the tone is distorted only by circuits that are switched on.

Further, the plurality of above switches 240 have a function of selecting any one of the plurality of level parts 510, selecting any one of the plurality of tone parts 520 or selecting any one of the plurality of distortion parts 530 of a plurality of component circuits (guitar effector modules).

As exemplified above, a description will be made on the premise that in playing one song, a combination of the distortion effector and the chorus effector is required at backing (accompaniment) (clean) and a combination of the distortion effector and the delay effector is required at solo performance (the level part (level) or the distortion effector should be larger adjusted during the solo performance as compared with the backing) (solo).

Before playing starts, in a state in which the distortion effector, the chorus effector and the delay effector of the guitar effector modules are coupled to the body 210, a player sets one (level 1) of the plurality of level parts 510 of the distortion effector to be small and sets the other one (level 2) to be large. In addition, the player makes setting such that in a state in which a clean switch of the plurality of switches 240 is switched on, the distortion effector is switched on, level 1 is selected, the chorus effector is switched on, and the delay effector is switched off, and makes setting such that in a state in which a solo switch is switched on, the distortion effector is switched on, level 2 is selected, the chorus effector is switched off, and the delay effector is switched on.

When backing is performed during the playing, as the clean switch of the plurality of switches 240 is switched on, the playing is performed in a state in which level 1 of the distortion effector is selected and the chorus effector is selected When solo performance is performed during the playing, as the solo switch of the plurality of switches 240 is switched on, the playing is performed in a state in which level 2 of the distortion effector is selected and the delay effector is selected.

Thus, even when the player cannot use his/her hands during the playing, the same effect as an effect that is obtained by adjusting a variable resistor driving part of the adjustment unit (dist) in the guitar effector module (the distortion effector) by hands may be obtained only though manipulation of a foot.

A power supply terminal 203 is installed in the body 210. Power supplied to the power supply terminal 203 is supplied to the plurality of component circuit boards 110 through the body power supply parts 223 of the plurality of body connection units 220 and the circuit power supply parts 123 of the plurality of circuit connection parts 120.

As described above, the body circuit serves to output a signal that is input through one of the plurality of body connection parts 220, through a subsequent body connection unit 220, and output a signal that is distorted by repeating this process to the output terminal.

Although the embodiments in which one component circuit board 110 of one guitar effector module 100 is switched on/off by one switch 240 have been described above, the body circuit of the body circuit board 230 may be formed such that one component circuit board 110 of one guitar effector module 100 is switched on/off by the plurality of switches 240 (programmable loop function).

For example, the body circuit may be formed such that a circuit of one chorus effector may be operated by a clean tone switch and a solo tone switch.

The present disclosure proposes a guitar effector that enables a guitar effector to obtain various desired tones only through manipulation of a foot switch during playing.

Although the above description merely corresponds to some exemplary embodiments that may be implemented by the present disclosure, as well known, the scope of the present disclosure should not be interpreted as being limited to the above-described embodiments, and all technical spirits having the same basis as that of the above-described technical spirit of the present disclosure are included in the scope of the present disclosure.

What is claimed is:

1. A guitar effector comprising:

an input unit that receives an input signal from a guitar or another guitar effector;

an output unit that transmits an output signal to an amplifier or the second guitar effector;

an adjustment unit that is installed between the input unit and the output unit to adjust a volume and a tone based on the output signal, wherein the adjustment unit comprises two or more level parts each configured to adjust and set a size of the output signal, two or more tone parts each configured to adjust and set an amount of high-pitched sound and an amount of low-pitched sound, and two or more distortion parts each configured to adjust and set a degree of distortion;

a first foot switch configured to select one of the two or more level parts by stepping on the first foot switch;

a second foot switch configured to select one of the two or more tone parts by stepping on the second foot switch; and a third foot switch configured to select one of the two or more distortion parts by stepping on the third foot switch.

2. The guitar effector of claim 1, wherein the first foot switch is a level switch for selecting any one of the two or more level parts.

3. The guitar effector of claim 1, wherein the second foot switch is a tone switch for selecting any one of the two or more tone parts.

4. The guitar effector of claim 1, wherein the third foot switch is a distortion switch for selecting any one of the two or more distortion parts.

5. A multi-type guitar effector in which a plurality of guitar effector modules are installed, each of the guitar effector modules comprising:

a component circuit board on which a component circuit for an analogue guitar effector is formed;

a module case on which an adjustment unit that adjusts a volume or a tone based on an output signal by the component circuit mounted and in which the component circuit board is installed; and a circuit connection unit in which a circuit input part, a circuit output part and a circuit power supply part for the component circuit are formed and which is electrically connected to the component circuit board and is installed outside the module case as well, wherein the adjustment unit comprises two or more level parts that adjust a size of the output signal, two or more tone parts that adjust an amount of high-pitched sound and an amount of low-pitched sound, or two or more distortion part that adjusts a degree of distortion, and the multi-type guitar effector comprising:

a body in which a module mounting space for mounting the plurality of guitar effector modules is formed;

a plurality of opened parts that are formed on an upper surface of the body to have a shape corresponding to the plurality of module cases such that the plurality of module cases are installed therein;

a plurality of body connection units in which body input parts, body output parts, and body power supply parts are formed to be connected to the circuit input parts, the circuit output parts, and the circuit power supply parts of the plurality of circuit connection units, respectively;

a body circuit board which is connected to the plurality of body connection units, on which a body circuit mounting space of the body is mounted, and in which a body circuit is formed as well;

an input terminal that is formed in the body to receive an input signal from a guitar and is connected to the body circuit as well;

an output terminal that is formed in the body to transmit an output signal to an amplifier and is connected to the body circuit as well; and a plurality of switches installed in the body or a separate device connected to the body, the switches or the separate device being configured to switch on or off entire or part of the plurality of component circuits and to select any one of the two or more level parts, select any one of the two or more tone parts or select any one of the two or more distortion parts, wherein the body circuit performs a control such that the input signal received through the input terminal is distorted by sequentially passing through the plurality of component circuits and the distorted signal is distorted through the output terminal.

6. The multi-type guitar effector of claim 5, wherein the switches perform a control such that any one of the two or more level parts is selected.

7. The multi-type guitar effector of claim 5, wherein the switches perform a control such that any one of the two or more tone parts is selected.

8. The multi-type guitar effector of claim 5, wherein the switches perform a control such that any one of the two or more distortion parts is selected.

9. The multi-type guitar effector of claim 5, wherein the body circuit performs a control such that the input signal received through the input terminal is transmitted to the circuit input parts of the plurality of circuit connection units through the body output parts of the plurality of body connection units, respectively, and the signal distorted by the plurality of component circuits is transmitted to the body input parts of the plurality of body connection units through the circuit output parts of the plurality of circuit connection units, respectively, and is output through the output terminal.

* * * * *